US006925904B2

(12) United States Patent
Sundaesan et al.

(10) Patent No.: US 6,925,904 B2
(45) Date of Patent: Aug. 9, 2005

(54) ADJUSTABLE PEDAL MECHANISM WITH TAPERED RIVET FOR AUTOMATIC GAP AND WEAR PROTECTION

(75) Inventors: Srini Sundaesan, Troy, MI (US); Gordon Smith, Lake Orion, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 225 days.

(21) Appl. No.: 10/288,111

(22) Filed: Nov. 5, 2002

(65) Prior Publication Data

US 2004/0083846 A1 May 6, 2004

(51) Int. Cl.[7] ..... G05G 1/14

(52) U.S. Cl. ..... 74/512; 74/560; 74/562.5; 74/513; 403/327; 403/151; 403/153; 403/154

(58) Field of Search ..... 74/512, 513, 514, 74/560, 562.5; 403/153, 154, 166, 147, 327; 92/190; B60R 21/09; G05G 1/14

(56) References Cited

U.S. PATENT DOCUMENTS

| | | | | | |
|---|---|---|---|---|---|
| 1,152,876 | A | * | 9/1915 | Brown et al. | 403/147 |
| 4,989,474 | A | | 2/1991 | Cicotte | |
| 5,078,024 | A | | 1/1992 | Cicotte | |
| 5,289,758 | A | * | 3/1994 | Berlinger | 92/190 |
| 5,460,061 | A | | 10/1995 | Redding | |
| 5,588,338 | A | * | 12/1996 | Carr et al. | 74/560 |
| 5,632,183 | A | | 5/1997 | Rixon | |
| 5,697,260 | A | | 12/1997 | Rixon | |
| 5,722,302 | A | | 3/1998 | Rixon | |
| 5,819,593 | A | | 10/1998 | Rixon | |
| 5,937,707 | A | | 8/1999 | Rixon | |
| 5,964,125 | A | | 10/1999 | Rixon | |
| 5,983,746 | A | * | 11/1999 | Nawata et al. | 74/512 |
| 6,367,348 | B1 | | 4/2002 | Toelke | |
| 6,612,200 | B1 | * | 9/2003 | Rixon | 74/560 |
| 6,840,131 | B2 | * | 1/2005 | Matsumoto et al. | 74/512 |
| 2004/0234332 | A1 | * | 11/2004 | Burgstaler et al. | 403/327 |

FOREIGN PATENT DOCUMENTS

| | | | | |
|---|---|---|---|---|
| DE | 004112132 A1 | * | 10/1991 | 74/512 |
| DE | 004112133 A1 | * | 10/1991 | 74/512 |
| DE | 19501680 A1 | * | 8/1996 | 74/512 |
| DE | 10040270 A1 | * | 3/2002 | 74/512 |
| EP | 001319557 A2 | * | 6/2003 | 74/512 |
| WO | WO 03/106234 A1 | * | 12/2003 | 74/512 |

* cited by examiner

*Primary Examiner*—Vinh T. Luong
(74) *Attorney, Agent, or Firm*—Richard M. Mescher; Porter Wright; Dean B. Watson

(57) ABSTRACT

A control pedal assembly includes a first support and a second support adjustable in a fore-aft direction relative to the first support. At least one guide is carried by the second support and has a tapered engagement surface engaging the first support and moving along the first support as the second support is adjusted in the fore-aft direction. A spring member biases the tapered engagement surface of the at least one guide into engagement with the first support. A pedal is supported by the second support and is pivotable about a horizontal pivot axis. The second support carries the pedal as the second support is adjusted in the fore-aft direction.

26 Claims, 5 Drawing Sheets

ADJUSTABLE PEDAL MECHANISM WITH TAPERED RIVET FOR AUTOMATIC GAP AND WEAR PROTECTION

CROSS-REFERENCE TO RELATED APPLICATIONS

Not Applicable.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to control pedals for a motor vehicle and, more particularly, to control pedals which can be selectively adjusted to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the resulting seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. For example, U.S. Pat. Nos. 5,632,183, 5,697,260, 5,722,302, 5,819,593, 5,937,707, and 5,964,125, the disclosures of which are expressly incorporated herein in their entirety by reference, each disclose an adjustable control pedal assembly. The control pedal assembly includes a hollow guide tube, a rotatable screw shaft co-axially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal utilizes relatively high tolerance parts and as a result may be expensive to produce and unreliable over time. Accordingly, there is a need in the art for an improved adjustable control pedal assembly which selectively adjusts the position of the pedal to accommodate drivers of various size.

SUMMARY OF THE INVENTION

The present invention provides an adjustable control pedal assembly and a method of operating an adjustable control pedal assembly which overcomes at least some of the above-noted problems of the related art. According to the present invention, a control pedal assembly includes, in combination, a first support and a second support adjustable in a fore-aft direction relative to the first support. At least one guide is carried by the second support and has a tapered engagement surface engaging the first support and moving along the first support as the second support is adjusted in the fore-aft direction. A spring member biases the tapered engagement surface of the at least one guide into engagement with the first support. A pedal is supported by the second support and pivotable about a horizontal pivot axis. The second support carries the pedal as the second support is adjusted in the fore-aft direction.

According to different definition of the present invention, a control pedal assembly comprises, in combination, a first support having at least one bearing surface which forms an angle to horizontal and a second support adjustable in a fore-aft direction relative to the first support. At least one guide is carried by the second support and has a tapered engagement surface engaging the at least one bearing surface and moving along the at least one bearing surface as the second support is adjusted in the fore-aft direction. A spring member biases the tapered engagement surface of the at least one guide into engagement with the at least one bearing surface. A pedal is supported by the second support and pivotable about a horizontal pivot axis. The second support carries the pedal as the second support is adjusted in the fore-aft direction.

According to another different definition of the present invention, a control pedal assembly comprises, in combination, a first support having a pair of spaced-apart bearing surfaces and a second support adjustable in a fore-aft direction relative to the first support. A pair of guides pins are carried by the second support and each have a tapered engagement surface. The guide pins are disposed in opposed directions such that each of the tapered engagement surfaces engage a respective one of the pair of bearing surfaces. The tapered engagement surfaces move along the bearing surfaces of the first support as the second support is adjusted in the fore-aft direction. At least one spring member biases the tapered engagement surfaces into engagement with the bearing surfaces. A pedal is supported by the second support and pivotable about a horizontal pivot axis. The second support carries the pedal as the second support is adjusted in the fore-aft direction.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
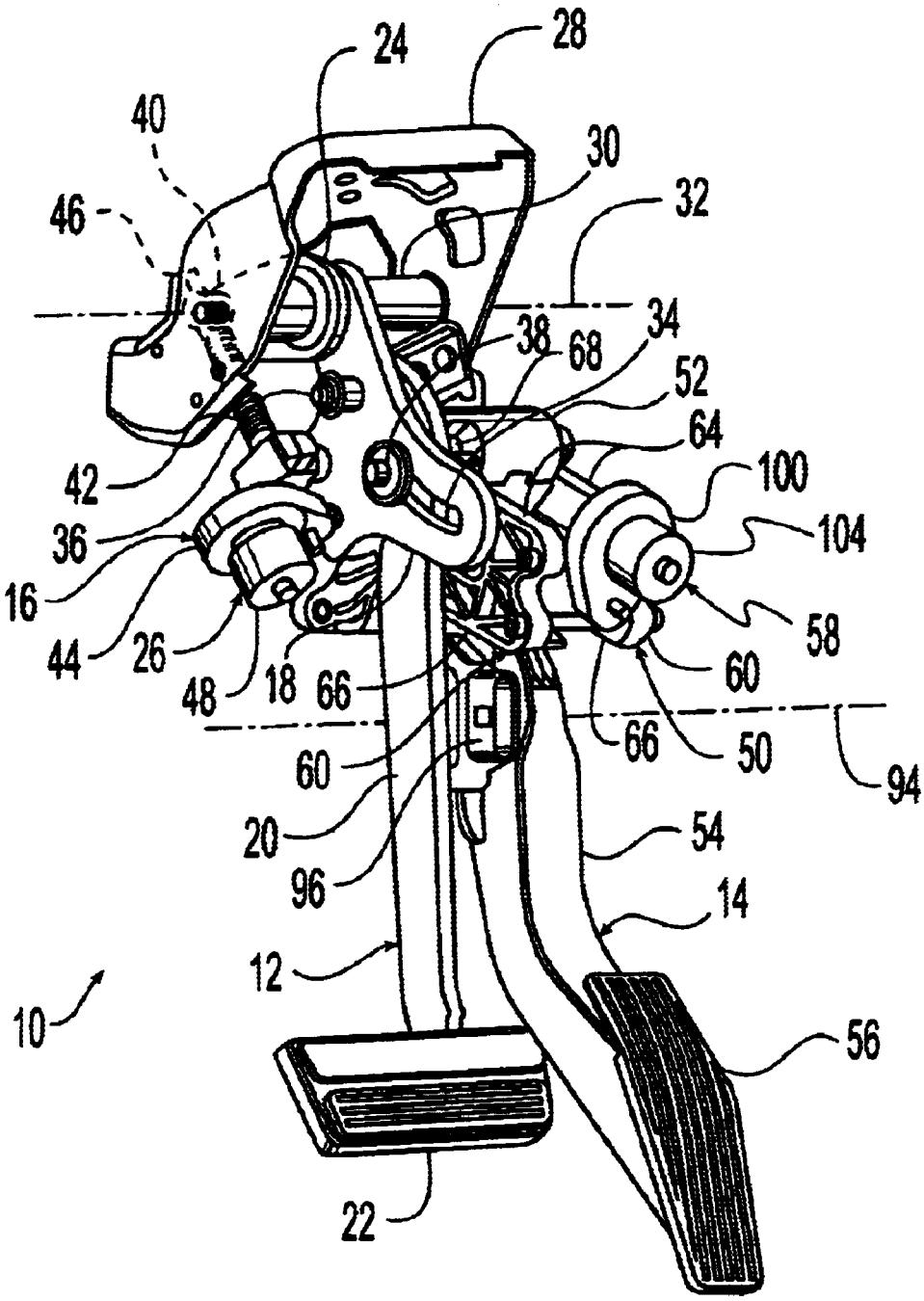
FIG. 1 is a perspective view of an adjustable control pedal assembly according to the present invention generally showing the left side of brake and accelerators pedals.
Figure 2:
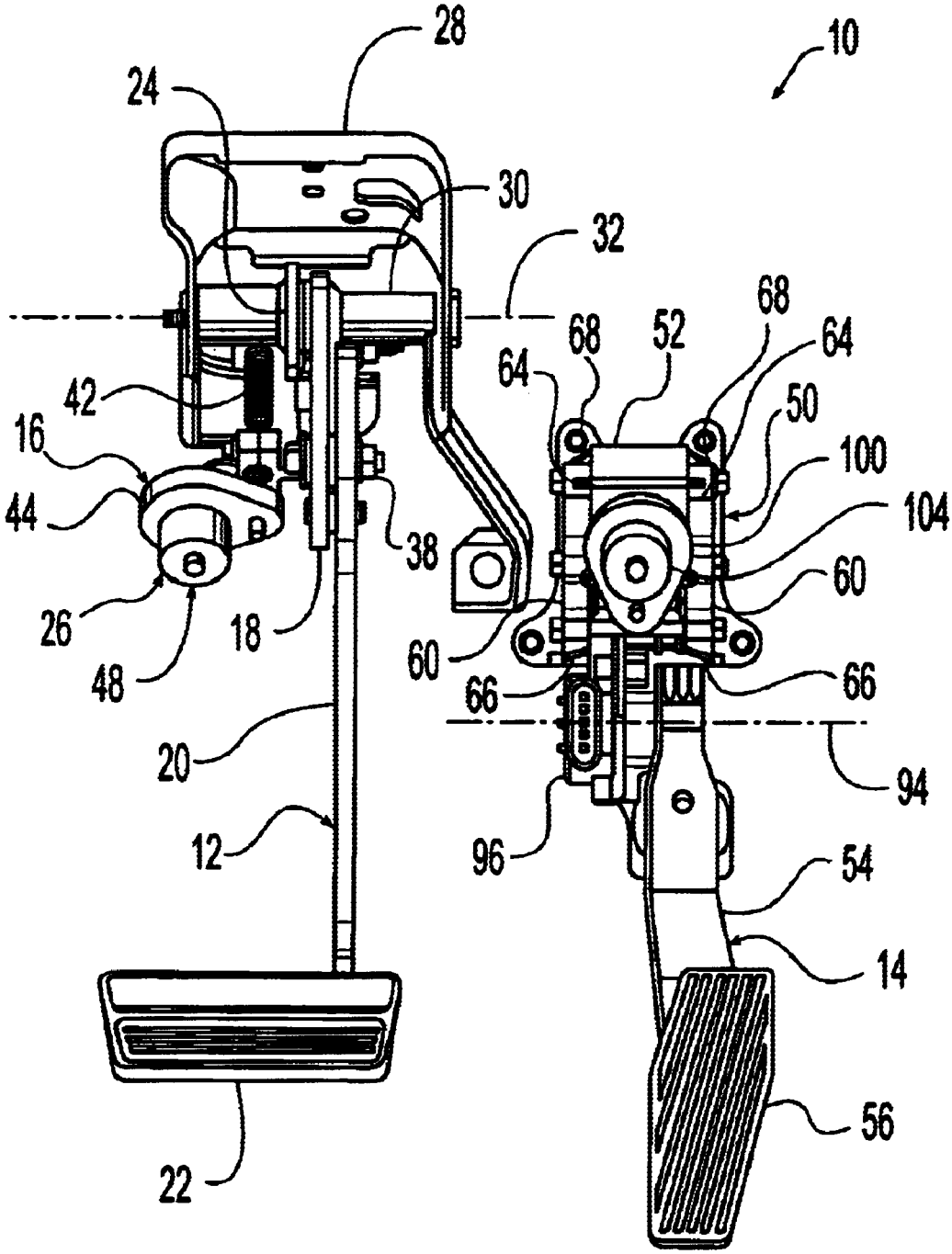
FIG. 2 is a rear elevational view of the adjustable control pedal assembly of FIG. 1.
Figure 3:
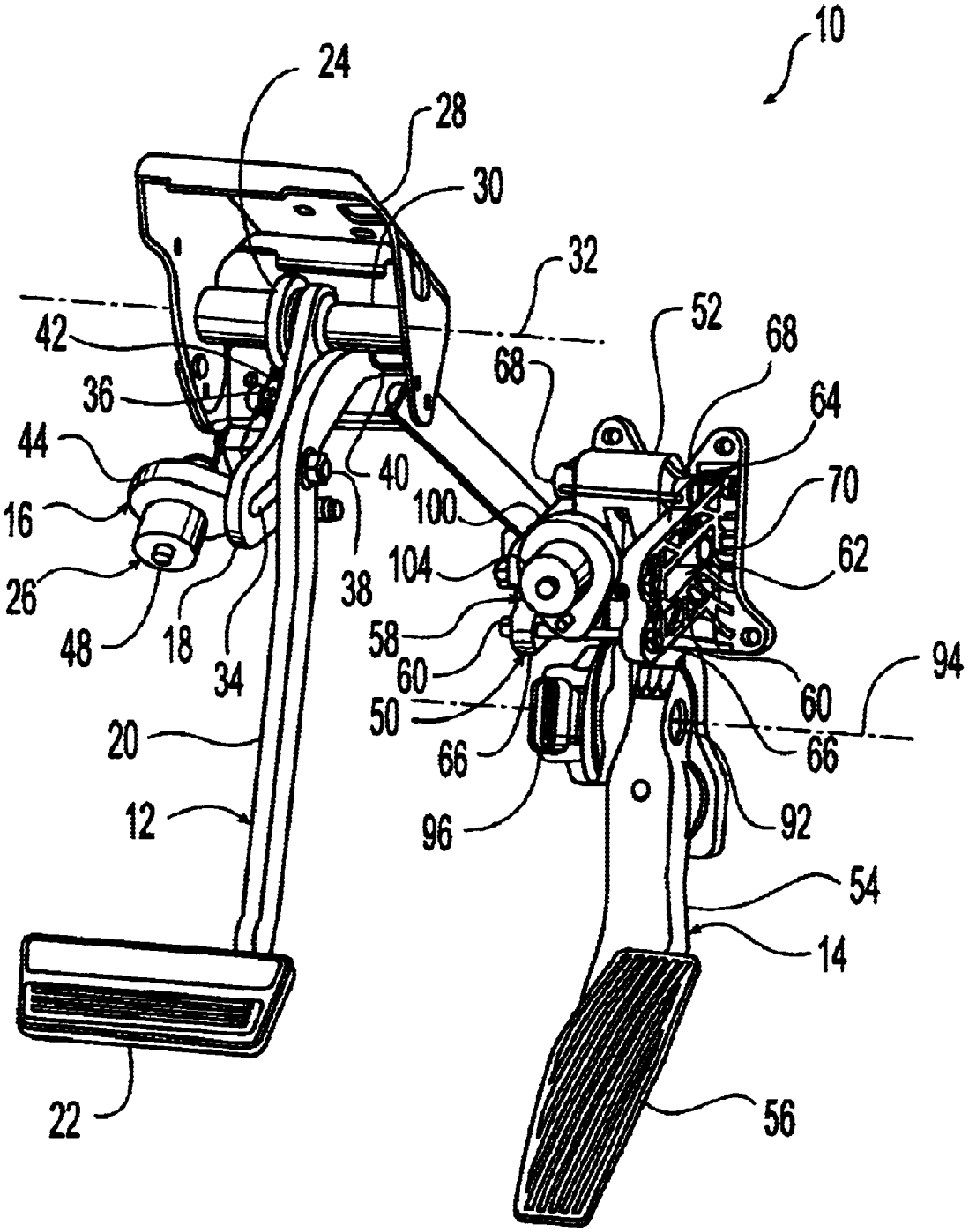
FIG. 3 is a perspective view of the adjustable control pedal assembly of FIGS. 1 and 2 generally showing the right side of the brake and accelerator pedals.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of the guides will be determined in part by the particular-intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction within the plane of the paper in FIG. 2 and down or downward refers to a down direction within the plane of the paper in FIG. 2. Also in general, fore or forward refers to a direction into the plane of the paper in FIG. 2, that is toward the front of the motor vehicle, and aft or rearward refers to a direction out of the plane of the paper in FIG. 2, that is toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure.

Referring now to the drawings, FIGS. 1 to 6 show a control pedal assembly 10 for a motor vehicle, such as an automobile, according to the present invention which is selectively adjustable to a desired position in the forward/rearward direction by a driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The control pedal assembly 10 includes a first or brake pedal 12, a second or accelerator pedal 14, and a control system 16 for selectively adjusting the position of the control pedals. While the illustrated embodiment includes two control pedals 12, 14, it is noted that according to the present invention the control pedal assembly can have a single control pedal such as, for example a brake, clutch or accelerator pedal, or more than two control pedals such as, for example, a brake, clutch and accelerator pedal.

The control pedals 12, 14 are selectively adjustable by the operator in the forward/rearward direction. In multiple pedal embodiments, the control pedals 12, 14 are preferably adjusted together simultaneously to maintain desired relationships between the control pedals 12, 14 in the forward/rearward direction such as, for example, "step over", that is, the forward position of the accelerator pedal 14 relative to the brake pedal 12. It is noted, however, that individual or separate adjustment of each control pedals 12, 14 can be utilized. It is particularly desirable to individually move the control pedals 12, 14 to reestablish desired relationships between the control pedals 12, 14 when desired relationships have not been maintained.

The illustrated first control pedal 12 is an brake pedal with mechanical connection to a brake system of the motor vehicle. The brake pedal 12 includes a support or upper arm 18, a support or lower arm 20 supported by the upper arm 18 and carrying a pad or pedal 22 for engagement by the foot of the motor vehicle operator, a link 24 pivotably connecting the lower arm 20, and a drive assembly 26 for moving the lower arm 20 relative to the upper arm 18 to adjust the position of the pedal 22.

The upper arm 18 is sized and shaped for pivotal attachment to a stationary support or mounting bracket 28. The mounting bracket 28 is adapted to rigidly attach the brake pedal 12 to a firewall or other rigid structure of the motor vehicle in a known manner. The upper arm 18 is adapted for pivotal attachment to the mounting bracket 28. The illustrated upper arm 18 has an opening formed for cooperation with the mounting bracket 28 and an axle or pivot pin 30. With the pivot pin 30 extending through the mounting bracket 28 and the upper arm 18, the upper arm 18 is pivotable relative to the fixed mounting bracket 28 about a horizontally and laterally extending pivot axis 32 formed by the central axis of the pivot pin 30.

The illustrated upper arm 18 is an elongate plate oriented in a vertical plane. The upper arm 18 is preferably formed of a suitable metal such as steel but can alternatively be formed of a suitable plastic such as NYLON. The upper arm 18 is adapted for supporting the lower arm 20 and for selected fore and aft movement of the lower arm 20 as described in more detail hereinafter. The illustrated upper arm 18 has an elongate opening or slot 34 formed therein which generally extends in a forward/rearward direction. The illustrated slot 34 is arcuate or curved and is rearwardly inclined, that is, the rearward end of the slot 34 is at a lower height than the forward end of the slot 34. The slot 34 is sized and shaped for cooperation with the lower arm 20 for desired forward/rearward movement of the pedal 22 relative the upper arm 18 over a desired adjustment range, such as about three inches, as described in more detail hereinbelow.

The upper arm 18 is operatively connected to a control device such as a brake such that pivotal movement of the upper arm 18 about the pivot axis 32 operates the control device in a desired manner responsive to the position of the pedal 22. The upper arm 18 can be connected to the control device by, for example, a push-pull or Bowden cable for mechanical actuation or by a sensor and electrical wire or cable for electronic actuation. The illustrated upper arm 18 is provided with a pin 36 for connection to the control device by a mechanical actuator.

The lower arm 20 is preferably formed of a suitable metal such as steel but can alternatively be formed of a suitable plastic such as NYLON. The illustrated lower arm 20 is formed of an elongate plate oriented in a vertical plane substantially parallel to plane of the upper arm 18. The upper end of the lower arm 20 is adapted for movement relative to upper arm 18 along the slot 34. The lower arm 20 is provided with a guide 38 in the form of a pin and a drive pin 40 laterally and horizontally extending therefrom to cooperate with the slot 34 and the link 24 to form sliding pin/slot and pivoting connections respectively for moving the lower arm 20 relative to the upper arm 18. A suitable guide 38 and a suitable drive pin 40 are described in U.S. Pat. No. 6,367, 349, the disclosure of which is expressly incorporated herein in its entirety by reference. The lower end of the lower arm 20 is sized and shaped to carry the rearward-facing pedal 22. The pedal 22 is adapted for depression by the driver of the motor vehicle to pivot the control pedal 12 about the pivot axis 32 to obtain a desired control input to the motor vehicle through the movement of the pin 36.

The link 24 is preferably formed of a suitable metal such as steel but can alternatively be formed of a suitable plastic such as NYLON. The illustrated link 24 is formed of an elongate plate oriented in a vertical plane substantially parallel to plane of the upper and lower arms 18, 20. The illustrated link 24 is pivotable about the pivot pin 30 and the pivot axis 32 The lower end of the link 24 is provided with an opening sized and shaped to cooperate with the drive pin 148.

The drive assembly 26 includes a screw shaft or drive screw 42, a drive screw attachment or housing 44 for securing the drive screw 42 to the upper arm 18, a drive nut 46 adapted for movement along the drive screw 42 in response to rotation of the drive screw 42, an electric motor 48 for rotating the drive screw 42. The drive screw 42 is an elongate shaft having a threaded portion adapted for cooperation with the drive nut 46. The drive screw 42 is preferably formed of a metal such as, for example, steel but can be alternately formed of a plastic resin such as, for example, NYLON. The rearward and downward end of the drive screw 42 is journaled by the drive screw housing 44 for rotation of the drive screw 42 by the motor 48. The illustrated drive screw 42 forwardly and upwardly extends from the drive screw housing 44 in a cantilevered fashion so that it extends forward of the upper arm 18. The drive screw 42 is preferably connected to the drive screw housing 44 with a self-aligning or freely pivoting joint, that is, a joint which freely permits pivoting of the drive screw 42 relative to the drive screw housing 44 and the upper arm 18 about at least axes perpendicular to the drive screw rotational axis. The self-aligning joint automatically corrects misalignment of the drive screw 42 and/or the drive nut 46. The self-aligning joint also allows nonlinear travel of the drive nut 46 upon pivoting of the link 24. The self aligning joint can be, for example, a ball/socket type joint. It is noted that alternatively the self aligning joint can be between the drive screw housing 44 and the upper arm 18.

The drive nut 46 is secured to the drive pin 40 and is adapted for axial movement along the drive screw 42 in response to rotation of the drive screw 42. The drive nut 46 is preferably molded of a suitable plastic material such as, for example, NYLON but can alternatively be formed of metal such as, for example steel. The drive pin 40 can be connected to the drive nut 46 with rigid connection or a self-aligning or freely pivoting joint, that is, a joint which freely permits pivoting of the drive nut 46 relative to the drive pin 40 about at least axes perpendicular to the rotational axis of the drive screw 42. The self-aligning joint automatically corrects misalignment of the drive nut 46 and/or drive screw 42. The self aligning joint can be, for example, a ball/socket type joint.

The electric motor 48 can be of any suitable type and is secured to upper arm 18 so that the motor 48 is carried by the upper arm 18 and pivots with the upper arm 18 about the pivot axis 32. The motor 48 is operably connected to the rearward or lower end of the drive screw 42 so that rotation of the motor 48 rotates the drive screw 42. The motor 48 is directly connected to the drive screw 42, that is, a rigid connection is provided without the use of flexible cables or the like. It is noted that suitable gearing is provided between the motor 48 and the drive screw 42 as necessary depending on the requirements of the control pedal 12. Alternatively, the motor 48 can be secured in other locations and connected to the drive screw 42 by a suitable link such as, for example, a flexible cable.

To adjust the position of the pedal 22, the driver activates rotation of the motor 48 in the desired direction. Rotation of the motor 48 directly rotates the drive screw 42 and causes the drive nut 46 to axially move along the drive screw 42 in the desired direction. The drive nut 46 moves along the drive screw 42 because the drive nut 46 is held against rotation with the drive screw 42 by the drive pin 40. As the drive nut 46 axially moves along the drive screw 42, the drive pin 40 pivots the link 24 about its pivot axis 32 because the drive pin 40 is secured to the link 24. As the drive pin 40 pivots the link 24, the lower arm 20 is moved therewith to adjust the forward/rearward position of the pedal 22. As the lower arm 20 moves, the guide 38 slides along the slot 34. With such movement, the pedal 22 travels in a substantially linear and horizontal path, that is, the pedal 22 moves in a forward/rearward direction and generally remains at the same height relative to the fixed mounting bracket 28 and the upper arm 18 which does not move relative the mounting bracket 28 during adjustment of the pedal 22. It is noted that the pedal 22 rotates as the lower arm 20 moves so that the orientation of the pedal 22 slightly changes. As the position of the pedal 22 is adjusted by rotating the drive screw 42, the upper arm 18 remains in fixed position relative to the mounting bracket 28. It can be seen from the above description that activation of the motor 48 changes the position of the lower arm 20 relative to the upper arm 18 but not the position of the upper arm 18 relative to the mounting bracket 28 and therefore does not affect the connection of the upper arm 18 to the control device of the motor vehicle through the pin 36.

The illustrated second control pedal 14 is an accelerator pedal having electronic throttle control, that is, an electronic connection to the throttle system of the motor vehicle. The accelerator pedal 14 includes a stationary first support or mounting bracket 50, a second support or upper arm 52 supported by the mounting bracket 50, a pedal arm or lower arm 54 supported by the upper arm 52 and carrying a pad or pedal 56 for engagement by the foot of the motor vehicle operator, and a drive assembly 58 for moving the upper arm 52 relative to the mounting bracket 50 to adjust the position of the pedal 56.

The mounting bracket 50 is adapted to rigidly attach the accelerator pedal 14 to a firewall or other rigid structure of the motor vehicle in a known manner. The upper arm 52 is adapted for fore/aft movement relative to the mounting bracket 50. The illustrated mounting bracket 50 has the pair of vertically extending and laterally-spaced-apart walls 60. Each wall 60 has a guide slot 62 formed therein which generally extends in a forward/rearward direction. The illustrated slots 62 are each substantially straight and horizontal. The walls 60 also each provide horizontal and laterally spaced-apart top and bottom guide or bearing surfaces 64, 66 formed by the top and bottom of the walls 60. The illustrated top and bottom bearing surfaces 64, 66 are located directly above and below the slots 62 respectively. The slots 62 and bearing surfaces 64, 66 are sized and shaped for cooperation with the upper arm 52 for substantially linear forward/rearward movement of the pedal 56 relative the mounting bracket 50 over a desired adjustment range, such as about three inches, as described in more detail hereinbelow. The illustrated top bearing surfaces are planar and substantially horizontal. The illustrated bottom bearing surfaces 66 are planar and at an angle A relative to horizontal (best shown in FIG. 6). A suitable angle A is believed to be about 15 to about 20 degrees from horizontal. The bottom bearing surfaces 66 are each angled inward to generally face toward each other. The mounting bracket 50 is preferably formed of a suitable plastic such as NYLON but can alternatively be formed of any suitable material such as a suitable metal like steel.

Figure 4:
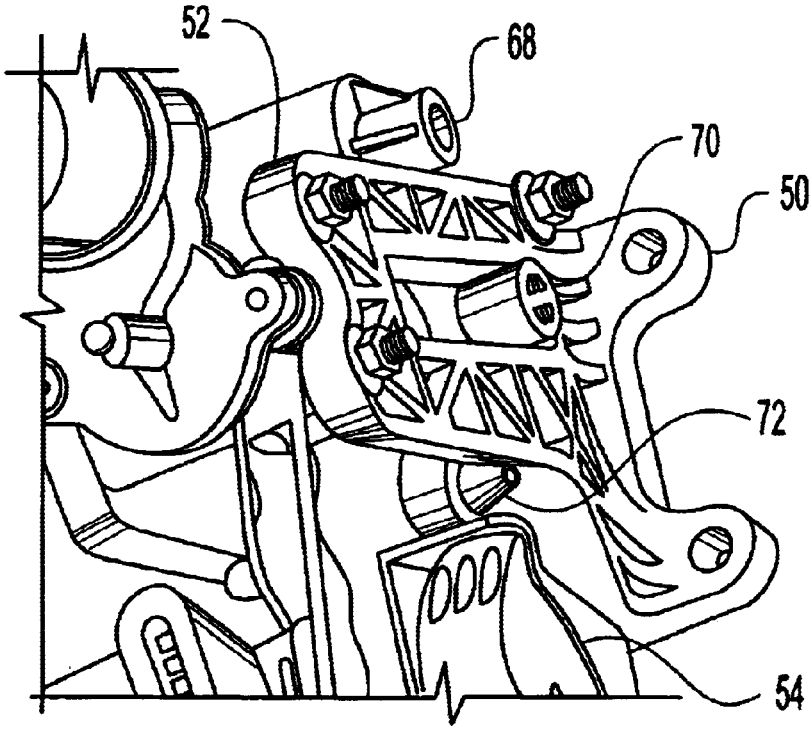
FIG. 4 is a fragmented, enlarged elevational view of a portion of the accelerator pedal of FIGS. 1 to 3 showing the right side of the accelerator pedal in the area of guides.
Figure 5:
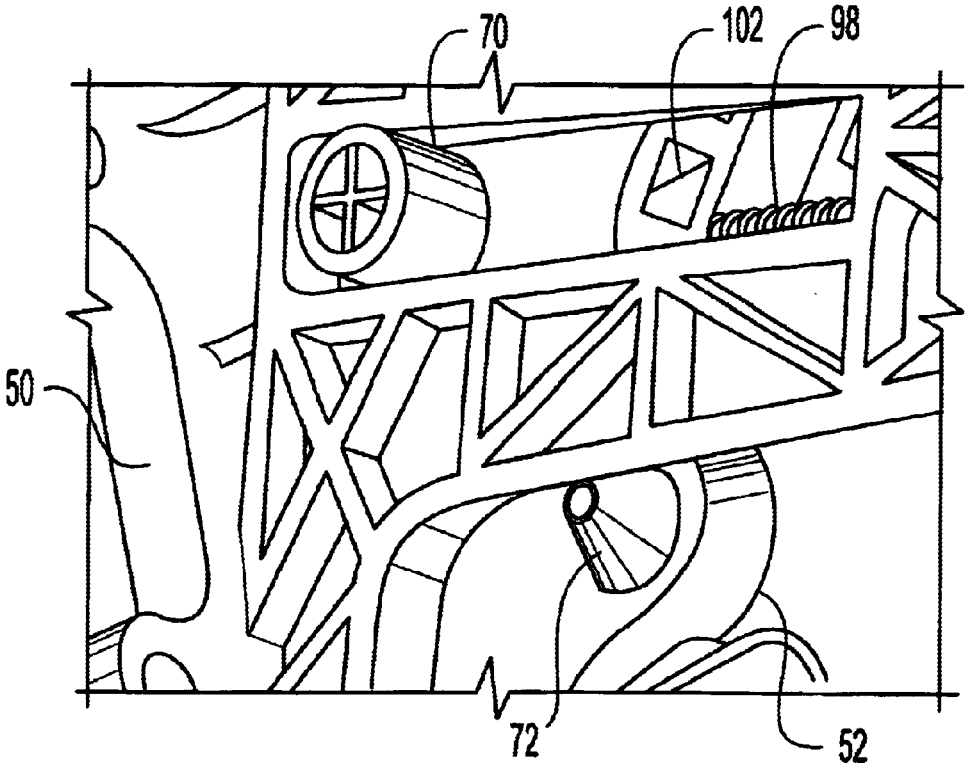
FIG. 5 is a fragmented, enlarged elevational view of a portion of the accelerator pedal of FIGS. 1 to 3 showing the left side of the accelerator pedal in the area of the guides.

The upper arm 52 is adapted for linear movement relative to mounting bracket 50 along the slots 62 and the bearing surfaces 64, 66. The upper arm 52 is preferably formed of a suitable plastic such as NYLON but can alternatively be formed of any suitable material such as a suitable metal like steel. As best shown in FIGS. 4 and 5, the upper arm 52 is provided with upper guides or supports 68 in the form of opposed laterally extending pins which engage the top bearings surfaces 64 at the top of the mounting bracket walls 60. The illustrated upper guides are cylindrically-shaped. The upper arm 52 is also provided intermediate guides or supports 70 in the form of opposed, laterally extending pins which extend into the slots 62 of the mounting bracket 50 to form sliding pin and slot connections for linearly moving the upper arm 52 relative to the mounting bracket 50. The illustrated intermediate guides are cylindrically-shaped. The upper arm 52 is further provided with lower guides or supports 72 in the form of opposed, laterally extending tapered pins or rivets which engage the bottom bearing surfaces 66 of the mounting bracket walls 60. The illustrated lower guides are frusto-conically shaped.

Figure 6:
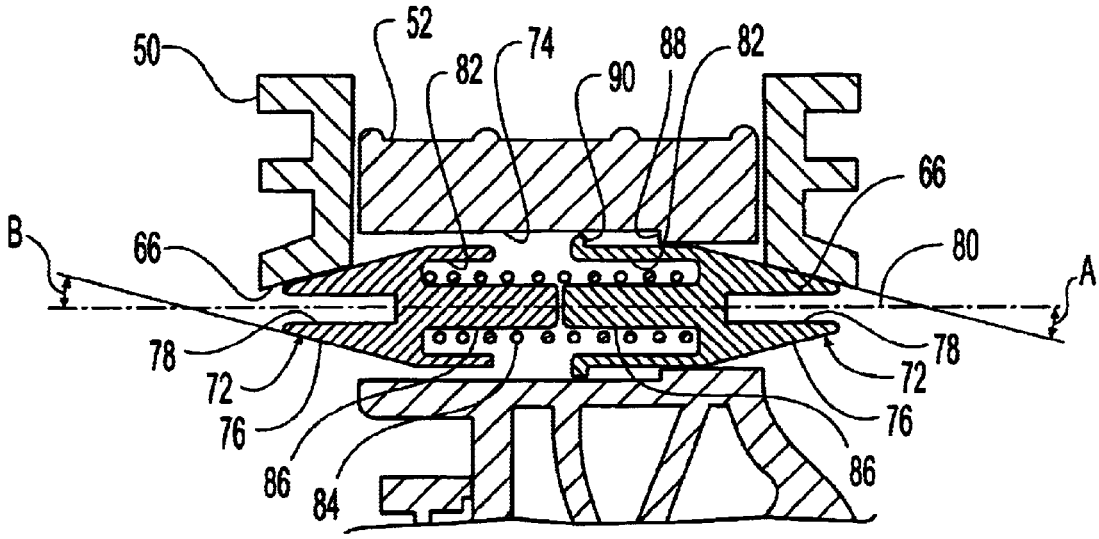
FIG. 6 is an enlarged, fragmented rear elevational view, in cross-section, of a portion of the accelerator pedal of FIGS. 1 to 3 showing guides.

As best shown in FIG. 6, the lower guides 72 are laterally moveable within a passage or opening 74 laterally extending through the upper arm 52. Each lower guide 72 includes a frusto-conical or tapered engagement surface 76 sized and shaped to cooperate with the bottom bearing surface 66 of the mounting bracket 50. The tapered engagement surface 76 is at an angle B relative to the central axis 80 of the lower guide 72 which is substantially horizontal. Preferably, the tapered engagement surface 76 is at an angle B of about 15 to about 20 degrees relative to the central axis 80. Each illustrated lower guide 72 is provided with a blind bore 78 at its outer end at the central axis 80 of the lower guide 72. Each lower guide 72 is provided with an annular shaped cavity 82 at its inner end to form a seat for a spring member 84. The illustrated spring member 84 is a compression helical-coil spring acting on each of the lower guides 72 to bias the lower guides 72 in outward directions and into engagement with the bottom bearing surfaces 66. It is noted that other suitable types of spring members 84 can be utilized to resiliently bias the lower guides 72 in to engagement with the bottom bearing surface such 66 as, for example, leaf springs, torsion springs, gas springs, or tension springs. It is also noted that separate spring members 84 can alternatively be utilized to bias the two lower guides 72. The cavities 82 form supports 86 which cooperate to support the spring member 84. Preferably, at least one of the supports 86 extends beyond the end of its cavity 82.

The illustrated opening 74 forms an inward-facing and annular shaped abutment 88 which cooperates with an outward-facing and annular-shaped abutment 90 formed by the inner end of one of the lower guides 72 (the right side lower guide in the illustrated embodiment). The abutments 88, 90 prevent the lower guides 72 from entering and exiting the opening 74 in one direction. In the illustrated embodiment, the lower guides 72 can only be inserted and removed from the left end of the opening 74. Preferably, the abutments 88, 90 and lower guides 72 are sized and shaped such that as one lower guide 72 engages the abutment 88, the other lower guide 72 is located completely within the opening 74 in order to assist assembly and disassembly of the accelerator pedal 14.

The spring member 84 resiliently biases each of the lower guides 72 outward, that is, in opposed directions toward the laterally spaced apart bottom bearing surfaces 66. The spring member 84 resiliently biases tapered engagement surfaces 76 of the lower guides 72 into engagement with the bottom bearing surfaces 66 of the mounting bracket 50. The spring member 84 automatically compensates for any gap which may be present between the lower guides 72 and the bottom bearing surface 66 due to tolerance build-up of the components by biasing the lower guides 72 to ensure that there is contact between the lower guides 72 and the bottom bearing surface 66. As a result, components can be manufactured with less exact tolerances. Additionally, the spring member 84 automatically compensates for component wear by biasing the lower guides 72 to ensure that there is contact between the lower guides 72 and the bottom bearing surface 66. As the accelerator pedal 14 is operated over time, the lower guides 72 and/or the mounting bracket 50 wear due to the sliding action of the tapered engagement surfaces 76 along the bottom bearing surfaces 66. As material, the spring member 84 automatically adjusts the position of the lower guides 72 to ensure that contact is maintained between the angled surfaces 66, 76.

The upper end of the lower arm 54 is pivotably mounted to the upper arm 52 about a pivot 92. Mounted in this manner, the lower arm 54 is pivotable relative to the upper arm 52 about a horizontally and laterally extending pivot axis 94 formed by the central axis of the pivot 92. The lower arm 54 is preferably formed of a suitable plastic such as NYLON but can alternatively be formed of any suitable material such as a suitable metal like steel. The lower end of the lower arm 54 is sized and shaped to carry the rearward-facing pedal 56. The pedal 56 is preferably unitary with the lower arm 54 such as by molding but alternatively can be attached to the lower arm 54. The pedal 56 is adapted for depression by the driver of the motor vehicle to pivot the pedal 56 about the pivot axis 94 to obtain a desired control input to the motor vehicle.

The lower arm 54 is operatively connected to a control device such as a motor vehicle throttle such that pivotal movement of the lower arm 54 about the pivot axis 94 operates the control device in a desired manner corresponding to the position of the pedal 56. The illustrated lower arm 54 is connected to the control device by an electronic throttle control module ("ETC module") 96 for electronic actuation. The ETC module 96 senses pivotable movement and/or position of the lower arm 54 relative to the upper arm 52 and sends electronic signals regarding such via a electric cable or wire connected thereto. The electronic throttle control module 96 can be of any suitable type known in the art.

The drive assembly 58 includes a screw shaft or drive screw 98, a drive screw attachment or housing 100 for securing the drive screw 98 to the mounting bracket 50, a drive nut 102 adapted for movement along the drive screw 98 in response to rotation of the drive screw 98, an electric motor 104 for rotating the drive screw 98. The drive screw 98 is an elongate shaft having a threaded portion adapted for cooperation with the drive nut 102. The drive screw 98 is preferably formed of a metal such as, for example, steel but can be alternately formed of a plastic resin such as, for example, NYLON. The rearward end of the drive screw 98 is journaled by the drive screw housing 100 for rotation of the drive screw 98 by the motor 104. The illustrated drive screw 98 forwardly extends from the drive screw housing in a cantilevered fashion between the walls 60 of the mounting bracket 50.

The drive nut 102 is formed with and/or secured to the upper arm 52 and is adapted for axial movement along the drive screw 98 in response to rotation of the drive screw 98. The drive nut 102 is preferably molded of a suitable plastic material such as, for example, NYLON but can alternatively be formed of metal such as, for example steel.

The electric motor 104 can be of any suitable type and is secured to the mounting bracket 50 so that the motor 104 is supported by the mounting bracket 50. The motor 104 is operably connected to the rearward end of the drive screw 98 so that rotation of the motor 104 rotates the drive screw 98.

The motor 104 is directly connected to the drive screw 98, that is, a rigid connection is provided without the use of flexible cables or the like. It is noted that suitable gearing is provided between the motor 104 and the drive screw 98 as necessary depending on the requirements of the control pedal 14. Alternatively, the motor 104 can be secured in other locations and connected to the drive screw 98 by a suitable link such as, for example, a flexible cable.

To adjust the accelerator pedal 14, the driver activates rotation of the motor 104 in the desired direction. Rotation of the motor 104 rotates the drive screw 98 and causes the drive nut 102 to axially move along the drive screw 98 in the desired direction. The drive nut 102 moves along the drive screw 98 because the drive nut 102 is held against rotation with the drive screw 98 by the upper arm 52. As the drive nut 102 axially moves along the drive screw 98, the upper guides 68 move along the top bearing surfaces 64 formed by the top of the mounting bracket 50, the intermediate guides 70 move along the slots 62, and the lower guides 72 move along the bottom bearing surfaces 66 formed by the bottom of the mounting bracket 50. As the guides 68, 70, 72 slidingly move along the mounting bracket surfaces 62, 64, 66, the upper arm 52 is moved and the lower pedal arm 54 is carried therewith. With such movement, the pedal 56 travels in a substantially linear and horizontal path, that is, the pedal 56 moves in a forward/rearward direction and generally remains at the same height relative to the fixed mounting bracket 50 during adjustment of the pedal 56. Additionally, the pedal 56 is not rotated as the upper arm 52 moves so that the orientation of the pedal 56 does not substantially change. It can be seen from the above description that activation of the motor 104 changes the position of the upper and lower arms 52, 54 relative to the mounting bracket 50 but not the position of the upper arm 52 relative to the lower arm 54 and therefore does not affect the rotational sensing of the ETC module 96.

The control system 16 preferably includes a central processing unit (CPU) or controller for activating the motors 48, 104, control switches for inputting information from the driver to the controller, and switches or sensors for detecting motion of the control pedals 12, 14. The control system 16 preferably forms a control loop wherein the controller selectively sends signals to the motors 48, 104 to activate and deactivate the motors 48, 104. See U.S. patent application Ser. No. 10/234,724, the disclosure of which is expressly incorporated herein in its entirety, for a suitable control system 16.

It is noted that each of the features of the various disclosed embodiments can be used with each of the other disclosed embodiments.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the tapered guides can also be utilized with other bearing surfaces such as for example the top bearing surfaces 64 and/or the slots 34, 62. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal assembly comprising, in combination:

a first support;

a second support;

a pedal arm supported by the second support and having an aft facing pedal at a lower end;

wherein the pedal arm pivots relative to the second support about a pivot axis horizontally extending in a lateral direction when a force is applied to a pedal;

a drive assembly connected to the second support to selectively move the second support and the pedal arm relative to the first support in a fore-aft direction perpendicular to the pivot axis during operation of the control pedal assembly;

wherein the pivot axis of the pedal arm moves in the fore-aft direction as the second support is moved in the fore-aft direction;

at least one guide carried by the second support and having a tapered engagement surface engaging the first support and moving along the first support in the fore-aft direction as the second support is adjusted in the fore-aft direction;

a spring member biasing the tapered engagement surface of the at least one guide into engagement with the first support; and wherein the second support carries the pedal arm as the second support is moved in the fore-aft direction to adjust the position of the pedal.

2. The control pedal assembly according to claim 1, wherein the at least one guide is in the form of a tapered pin having a central axis.

3. The control pedal assembly according to claim 2, wherein the tapered engagement surface forms an angle of 15 to 20 degrees with the central axis.

4. The control pedal assembly according to claim 1, wherein there are at least two of the guides which are disposed in opposed directions.

5. The control pedal assembly according to claim 1, wherein the spring member is a helical-coil compression spring.

6. The control pedal assembly according to claim 1, wherein the first support has at least one bearing surface which forms an angle to horizontal and is engaged by the tapered engagement surface of the at least one guide.

7. The control pedal assembly according to claim 6, wherein the bearing surface forms an angle of about 15 to about 20 degrees to horizontal.

8. The control pedal assembly according to claim 1, wherein the tapered engagement surface is conical shaped.

9. The control pedal assembly according to claim 1, wherein the drive assembly includes an electric motor.

10. A control pedal assembly comprising, in combination:

a first support having at least one planar bearing surface which forms an angle to horizontal;

a second support;

a pedal arm supported by the second support and having an aft facing pedal at a lower end;

wherein the pedal arm pivots relative to the second support about a pivot axis horizontally extending in a lateral direction when a force is applied to a pedal;

a drive assembly connected to the second support to selectively move the second support and the pedal arm relative to the first support in a fore-aft direction perpendicular to the pivot axis during operation of the control pedal assembly;

wherein the pivot axis of the pedal arm moves in the fore-aft direction as the second support is moved in the fore-aft direction;

at least one guide carried by the second support and having a tapered engagement surface engaging the at least one planar bearing surface and moving in the fore-aft direction along the at least one bearing surface as the second support is moved in the fore-aft direction; and a spring member biasing the tapered engagement surface of the at least one guide into engagement with the at least one bearing surface;

wherein the second support carries the pedal arm as the second support is moved in the fore-aft direction to adjust the position of the pedal.

11. The control pedal assembly according to claim 10, wherein the at least one guide is in the form of a tapered pin having a central axis.

12. The control pedal assembly according to claim 11, wherein the tapered engagement surface forms an angle of 15 to 20 degrees with the central axis.

13. The control pedal assembly according to claim 10, wherein there are at least two of the guides which are disposed in opposed directions.

14. The control pedal assembly according to claim 10, wherein the spring member is a helical-coil compression spring.

15. The control pedal assembly according to claim 10, wherein the at least one bearing surface forms an angle of about 15 to about 20 degrees to horizontal.

16. The control pedal assembly according to claim 10, wherein the tapered engagement surface is conical shaped.

17. The control pedal assembly according to claim 10, wherein the drive assembly includes an electric motor.

18. A control pedal assembly comprising, in combination:

a first support having a pair of spaced-apart planar bearing surfaces;

a second support;

a pedal arm supported by the second support and having an aft facing pedal at a lower end;

wherein the pedal arm pivots relative to the second support about a pivot axis horizontally extending in a lateral direction when a force is applied to a pedal;

a drive assembly connected to the second support to selectively move the second support and the pedal arm relative to the first support in a fore-aft direction perpendicular to the pivot axis during operation of the control pedal assembly;

wherein the pivot axis of the pedal arm moves in the fore-aft direction as the second support is moved in the fore-aft direction;

a pair of guides pins carried by the second support and each having a tapered engagement surface;

wherein the guide pins are disposed in opposed directions such that each of the tapered engagement surfaces engage a respective one of the pair of planar bearing surfaces;

wherein the tapered engagement surfaces move in the fore-aft direction along the planar bearing surfaces of the first support as the second support is moved in the fore-aft direction;

at least one spring member biasing the tapered engagement surfaces into engagement with the planar bearing surfaces; and wherein the second support carries the pedal arm as the second support is moved in the fore-aft direction to adjust the position of the pedal.

19. The control pedal assembly according to claim 18, wherein the guides are in the form of tapered pins each having a central axis.

20. The control pedal assembly according to claim 19, wherein each of the tapered engagement surfaces form an angle of 15 to 20 degrees with the central axis.

21. The control pedal assembly according to claim 18, wherein the at least one spring member is a helical-coil compression spring.

22. The control pedal assembly according to claim 18, wherein the at least one spring member is a single spring biasing the pair of guides in opposed directions.

23. The control pedal assembly according to claim 18, wherein each of the bearing surfaces form an angle to horizontal.

24. The control pedal assembly according to claim 23, wherein each of the bearing surfaces form an angle of 15 to 20 degrees to horizontal.

25. The control pedal assembly according to claim 18, wherein the tapered engagement surfaces are each conical shaped.

26. The control pedal assembly according to claim 18, wherein the drive assembly includes an electric motor.

* * * * *